US009300088B2

(12) United States Patent
Tseng

(10) Patent No.: US 9,300,088 B2
(45) Date of Patent: Mar. 29, 2016

(54) ELECTRICAL CONNECTION DEVICE

(71) Applicant: Molex, LLC, Lisle, IL (US)

(72) Inventor: Ting-Chang Tseng, Taipei (TW)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/152,036

(22) Filed: Jan. 10, 2014

(65) Prior Publication Data

US 2014/0199874 A1 Jul. 17, 2014

(30) Foreign Application Priority Data

Jan. 11, 2013 (TW) ..... 102200689 U

(51) Int. Cl.
*H01R 13/64* (2006.01)
*H01R 13/641* (2006.01)
*H01R 13/62* (2006.01)

(52) U.S. Cl.
CPC ..... *H01R 13/64* (2013.01); *H01R 13/62* (2013.01); *H01R 13/641* (2013.01)

(58) Field of Classification Search
CPC .. H01R 12/724; H01R 12/716; H01R 13/516; H01R 13/62; H01R 13/639; H01R 13/627; H01R 13/6272; H01R 13/20; H01R 13/64; H01R 13/506; H01R 13/629; H01R 13/641; H01R 13/6271; H01R 43/26; H01R 24/60; H01R 24/61
USPC ..... 439/345, 144, 147, 310, 355, 660, 626, 439/676
See application file for complete search history.

(56) References Cited

U.S. PATENT DOCUMENTS

| | | | | |
|---|---|---|---|---|
| 6,619,859 | B1 * | 9/2003 | Minamino et al. | 385/92 |
| 6,685,500 | B2 * | 2/2004 | Nakamura | 439/489 |
| 6,884,106 | B2 | 4/2005 | Shuman et al. | |
| 7,144,268 | B2 | 12/2006 | Koenig et al. | |
| 2012/0034820 | A1 * | 2/2012 | Lang et al. | 439/660 |
| 2012/0322316 | A1 | 12/2012 | Chen et al. | |
| 2013/0095676 | A1 * | 4/2013 | Wu | 439/76.1 |

FOREIGN PATENT DOCUMENTS

| | | |
|---|---|---|
| CN | 201478607 U | 5/2010 |
| CN | 203056266 U | 7/2013 |
| JP | 07-192808 A | 7/1995 |

* cited by examiner

*Primary Examiner* — James Harvey
*Assistant Examiner* — Oscar C Jimenez
(74) *Attorney, Agent, or Firm* — Stephen L. Sheldon

(57) ABSTRACT

An electrical connection device comprises a receptacle connector which comprises a first insulative housing, a guide frame and a plug connector which comprises a second insulative housing. The first insulative housing has a mounting portion and a mating portion protruding from the mounting portion. The guide frame is assembled with the receptacle connector, and comprises a frame body, a female latch unit and a stopping block. The frame body is assembled to the mounting portion of the first insulative housing and has an opening to allow the mating portion to pass through. The female latch unit and the stopping block protrude from the frame body respectively and are positioned at opposite two sides and spaced apart from the mating portion to together define a mating space. The second insulative housing has a housing body and a male latch unit formed at one side of the housing body and engaged with the female latch unit. When the plug connector is incorrectly inserted, the plug connector cannot enter into the mating space to mate with the receptacle connector due to blocking from the stopping block of the guide frame.

16 Claims, 18 Drawing Sheets

ELECTRICAL CONNECTION DEVICE

REFERENCE TO RELATED APPLICATIONS

The Present Disclosure claims priority to prior-filed Taiwanese Patent Application No. 102200689, entitled "Electrical Connection Device," filed on 11 Jan. 2013 with the Taiwanese Intellectual Property Office. The content of the aforementioned Patent Application is incorporated in its entirety herein.

BACKGROUND OF THE PRESENT DISCLOSURE

The Present Disclosure relates, generally, to an electrical connection device, and, more specifically, to an electrical connection device comprising a guide frame.

Referring to FIGS. 1-2, an existing electrical connection device comprises a receptacle connector 91, a guide frame 92 and a plug connector 93. The guide frame 92 is assembled with the receptacle connector 91 together and has a female latch unit 921 to guide the plug connector 93 to mate with the receptacle connector 91, and the female latch unit 921 has a latching hole 922 to allow a latching block 931 of the plug connector 93 to insert, so as to make the plug connector 93 and the receptacle connector 91 relatively positioned to stably establish an electrical connection. FIG. 2 illustrates a correctly inserted status of the plug connector 93 that the plug connector 93 and the receptacle connector 91 are mated together and the latching block 931 of the plug connector 93 is inserted into the latching hole 922 of the guide frame 92, at this time the plug connector 93 and the receptacle connector 91 can correctly transmit a signal.

However, FIG. 3 illustrates an incorrectly inserted status of the plug connector 93 that the plug connector 93 and the receptacle connector 91 may be still mated together but the latching block 931 of the plug connector 93 and the female latch unit 921 of the guide frame 92 are positioned at opposite two sides of the receptacle connector 91 respectively, at this time the plug connector 93 and the receptacle connector 91 cannot transmit a signal. Since the existing electrical connection device is not provided with a mechanism for preventing the plug connector 93 from incorrectly inserting in, a user need to be careful not to incorrectly insert the plug connector 93. Moreover, if the user negligently inserts the plug connector 93 incorrectly, the user will mistakenly consider that the connector is damaged and fails to operate.

SUMMARY OF THE PRESENT DISCLOSURE

Therefore, an object of the Present Disclosure is to provide an electrical connection device which can prevent a plug connector from being incorrectly inserted.

According to an embodiment of the Present Disclosure, an electrical connection device comprises a receptacle connector, a guide frame and a plug connector. The receptacle connector comprises a first insulative housing. The first insulative housing has a mounting portion and a mating portion protruding from the mounting portion. The guide frame is assembled with the receptacle connector and comprises a frame body, a female latch unit and a stopping block. The frame body is assembled to the mounting portion of the first insulative housing and has an opening to allow the mating portion to pass through. The female latch unit and the stopping block protrude from the frame body and are positioned at opposite two sides of the mating portion respectively and spaced apart from the mating portion to together define a mating space. The plug connector comprises a second insulative housing. The second insulative housing has a housing body mated to the mating portion, and a male latch unit formed at one side of the housing body and engaged with the female latch unit. When the plug connector is correctly inserted, the plug connector can enter into the mating space along a mating direction to mate with the receptacle connector to make the male latch unit and the female latch unit locked and positioned in a releasable manner; when the plug connector is incorrectly inserted, the plug connector cannot enter into the mating space to mate with the receptacle connector due to blocking from the stopping block of the guide frame.

According to an embodiment of the Present Disclosure, the male latch unit comprises a resilient arm and two protection blocks positioned at two sides of the resilient arm respectively. The stopping block of the guide frame has a notch recessed from a middle portion of a top side thereof. When the plug connector is incorrectly inserted along the mating direction, the two protection blocks abut against the top side of the stopping block and the resilient arm is positioned correspondingly at the notch and does not contact the stopping block.

According to another embodiment of the Present Disclosure, the second insulative housing further has at least one protruding block formed at a corner of one side of the housing body opposite to the male latch unit. When the plug connector is correctly inserted, the protruding block is adjacent to the stopping block. When the plug connector is incorrectly inserted, the protruding block abuts against the female latch unit to make the plug connector cannot enter into the mating space.

According to another embodiment of the Present Disclosure, the female latch unit of the guide frame has a U-shaped wall and a latching hole formed in the U-shaped wall. The resilient arm of the male latch unit has a connecting portion extending from the housing body, a manipulation portion extending from the connecting portion and a latching block protruding between the connecting portion and the manipulation portion, the two protection blocks are positioned at two sides of the connecting portion respectively. When the plug connector is correctly inserted, the two protection blocks and the connecting portion are received inside of the U-shaped wall and the latching block can insert into the latching hole, and the protruding block is adjacent to the stopping block. When the plug connector is incorrectly inserted, the protruding block abuts against the top side of the U-shaped wall to make the plug connector cannot enter into the mating space.

According to another embodiment of the Present Disclosure, a side edge of the top side of the stopping block adjacent to the mating portion is formed as a guide surface. According to another embodiment of the Present Disclosure, the mounting portion of the first insulative housing is engaged with the guide frame via engagement of the dovetail block and the dovetail groove, and the receptacle connector, along with the guide frame, is mounted on a circuit board, the mating direction is perpendicular to the circuit board.

According to another embodiment of the Present Disclosure, an electrical connection device comprises a receptacle connector, a guide frame and a plug connector. The receptacle connector comprises a first insulative housing, the first insulative housing has a mounting portion and a mating portion protruding from the mounting portion. The guide frame is assembled with the receptacle connector and comprises a frame body and a female latch unit. The frame body is assembled to the mounting portion of the first insulative housing and has an opening to allow the mating portion to pass through. The female latch unit protrudes from the frame body and is spaced apart from the mating portion. The plug connector comprises a second insulative housing. The second insulative housing has a housing body mated to the mating portion, a male latch unit formed at one side of the housing body and engaged with the female latch unit, and a projection portion formed at one side of the housing body opposite to the male latch unit. When the plug connector is correctly inserted, the plug connector can mate with the receptacle connector along a mating direction to make the male latch unit and the female latch unit locked and positioned in a releasable manner. When the plug connector is incorrectly inserted, the projection portion abut against the female latch unit to make the plug connector cannot mate with the receptacle connector.

According to another embodiment of the Present Disclosure, the female latch unit of the guide frame has a U-shaped wall and a latching hole formed in the U-shaped wall. The male latch unit comprises a resilient arm, a connecting portion extending from the housing body, a manipulation portion extending from the connecting portion, and a latching block protruding between the connecting portion and the manipulation portion, and two protection blocks positioned at two sides of the connecting portion respectively. When the plug connector is correctly inserted, the two protection blocks and the connecting portion are received inside of the U-shaped wall and the latching block can insert into the latching hole. When the plug connector is incorrectly inserted, the projection portion abuts against a top side of the U-shaped wall. According to another embodiment of the Present Disclosure, the mounting portion of the first insulative housing is engaged with the guide frame via engagement of the dovetail block and the dovetail groove, and the receptacle connector, along with the guide frame, is mounted on a circuit board, the mating direction is perpendicular to the circuit board.

Accordingly, the effects of the Present Disclosure are that, when the plug connector of the Present Disclosure is incorrectly inserted, it cannot mate with the receptacle connector due to blocking from the guide frame, thereby effectively preventing a user from incorrectly inserting.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
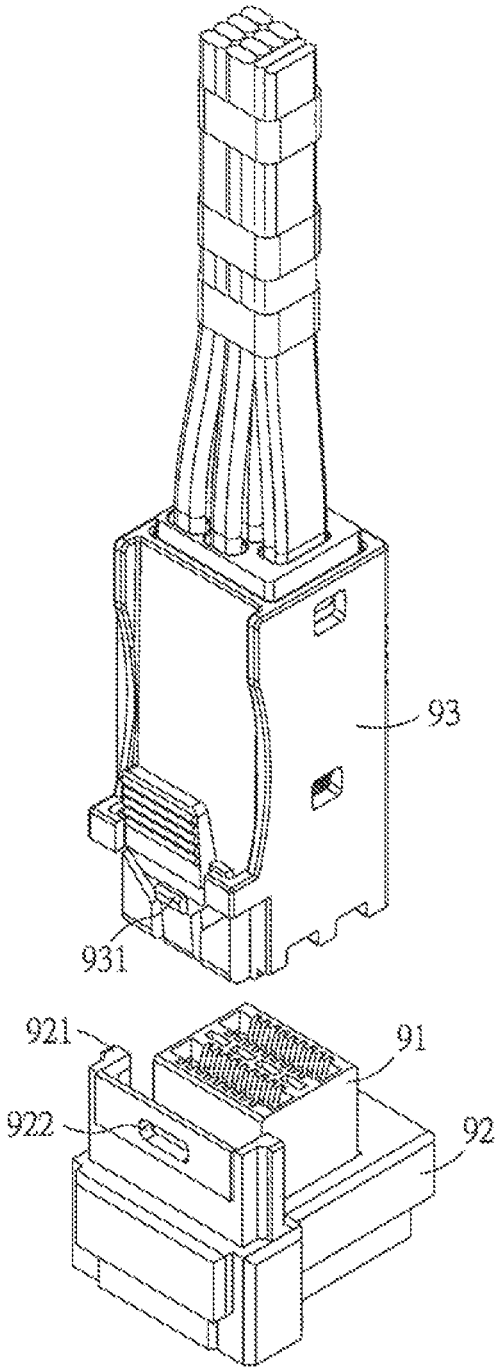
FIG. 1 PRIOR ART
FIG. 1 is a perspective view illustrating an existing electrical connection device, with a plug connector not mated with a receptacle connector.
Figure 2:
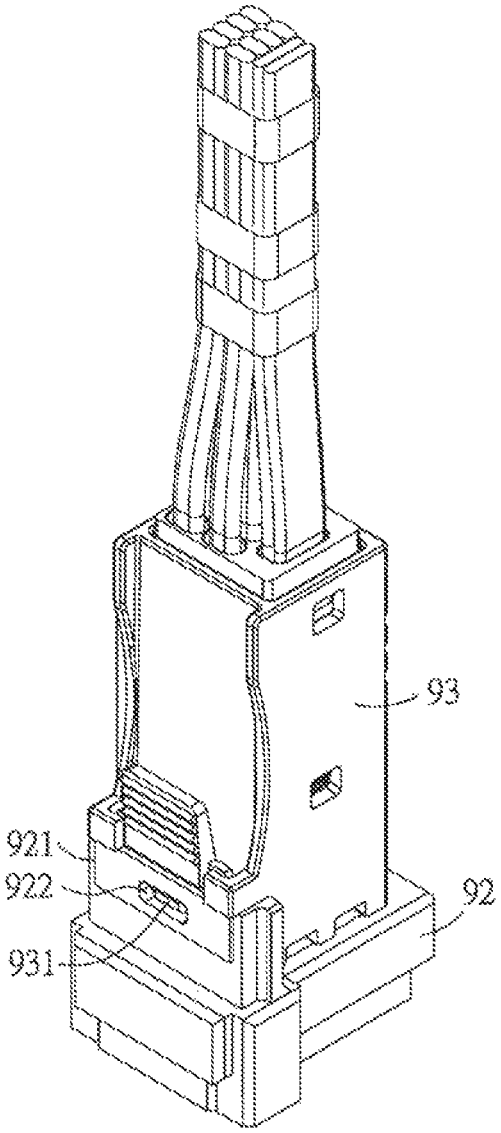
FIG. 2 PRIOR ART
FIG. 2 is a perspective view illustrating an existing electrical connection device, with a plug connector mated and correctly inserted into the receptacle connector.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Referring to FIGS. 4-7, an electrical connection device of a first embodiment of the Present Disclosure comprises a receptacle connector 1, a guide frame 2 and a plug connector 3. The receptacle connector 1 comprises a first insulative housing 11 and a plurality of terminals 12 provided to the first insulative housing 1. The first insulative housing 11 has a mounting portion 111 and a mating portion 112 protruding from the mounting portion 111, and the mating portion 112 is formed with two slots 113. The plurality of terminals 12 each have a resilient contact portion 121 extending into one of the slots 113 and a tail portion 122 extending out of the mounting portion 111 and electrically connected to a circuit board 8 (referring to FIG. 8).

Figure 8:
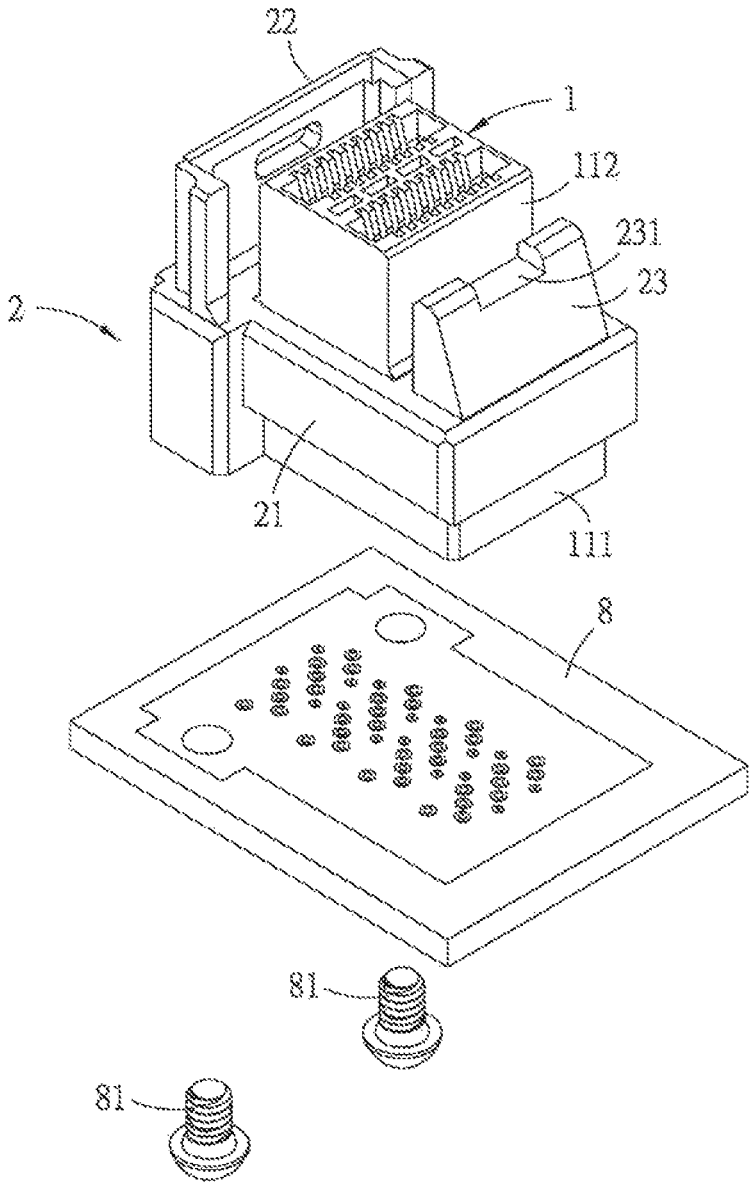
FIG. 8 is an exploded perspective view illustrating an assembly relationship of FIG. 5.
Figure 9:
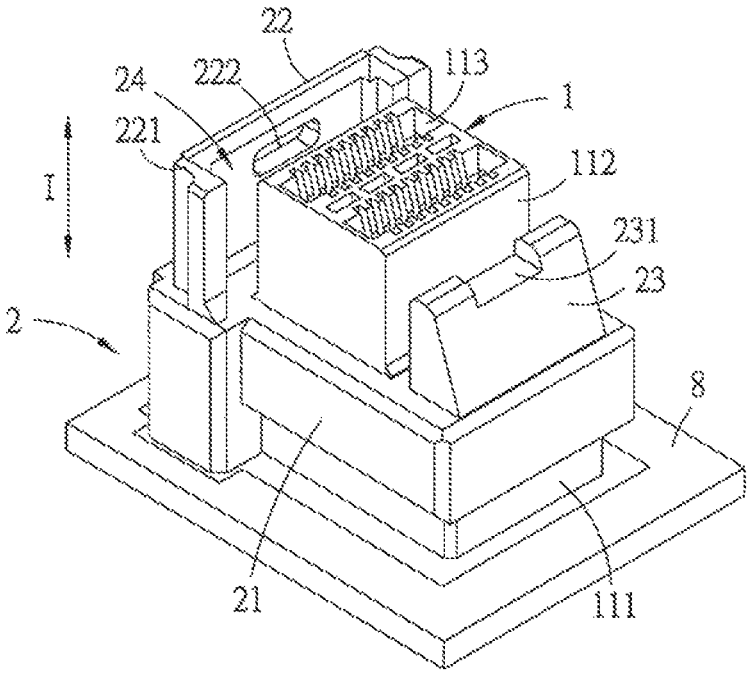
FIG. 9 is an assembly view of FIG. 8.
Figure 10:
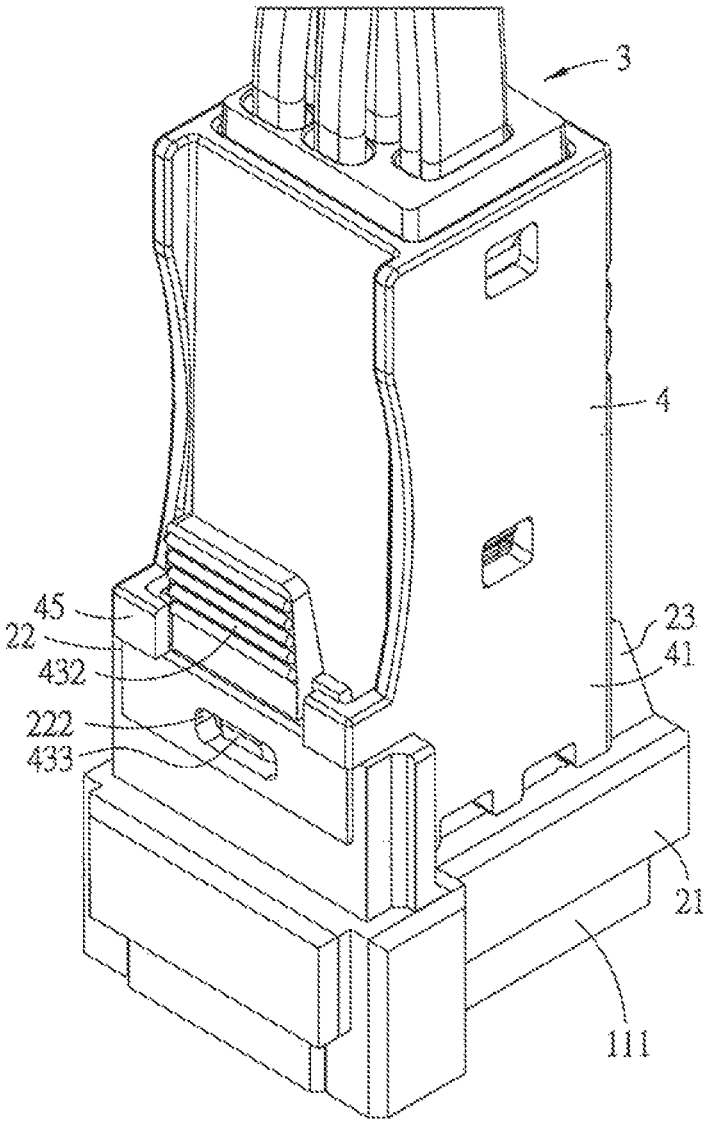
FIG. 10 is a perspective view illustrating a properly inserted plug connector of the first embodiment.

The guide frame 2 is assembled with the receptacle connector 1, and comprises a frame body 21, a female latch unit 22 and a stopping block 23. The frame body 21 is assembled to the mounting portion 111 of the first insulative housing 1 and has an opening 211 to allow the mating portion 112 to pass through. Specifically, the mounting portion 111 of the first insulative housing 1 is engaged with the guide frame 2 via an engagement of a dovetail block 212 and a dovetail groove 114. In the embodiment, the mounting portion 111 is formed with the two dovetail grooves 114 positioned at symmetrical positions, and the frame body 21 of the guide frame 2 is formed with the two dovetail blocks 212 corresponding to the two dovetail grooves 114 and protruding into the opening 211 respectively. In an equivalent embodiment, a dovetail groove may be formed in the frame body 21, and a dovetail block is formed in the mounting portion 111. The female latch unit 22 and the stopping block 23 protrude from the frame body 21 and are positioned at opposite two sides of the mating portion 112 respectively and spaced apart from the mating portion 112 to together define a mating space 24. The female latch unit 22 has a U-shaped wall 221 and a latching hole 222 formed in the U-shaped wall 221. The stopping block 23 has a notch 231 recessed from a middle portion of a top side thereof, and a side edge of the top side of the stopping block 23 adjacent to the mating portion 112 is formed as a guide surface 232. Referring to FIGS. 8-9, the receptacle connector 1, along with the guide frame 2, is mounted on the circuit board 8, and fastened by a screw 81. When the receptacle connector 1 and the guide frame 2 are mounted on the circuit board 8, entrances of the slots 113 and the mating space 24 face upwardly to allow that the plug connector 3 may mate with the receptacle connector 1 along a mating direction I perpendicular to the circuit board 8.

Referring to FIGS. 4, 6-7 and 10, the plug connector 3 comprises a second insulative housing 4 and a plurality of conductive insert plates 5 provided to the second insulative housing 4. The second insulative housing 4 has a housing body 41, which is mated to the mating portion 112, and a male latch unit 42, formed at one side of the housing body 41 and engaged with the female latch unit 22. The male latch unit 42 comprises a resilient arm 43 and two protection blocks 44 positioned respectively at two sides of the resilient arm 43. The resilient arm 43 has a connecting portion 431 extending from the housing body 41, a manipulation portion 432 extending from the connecting portion 431, and a latching block 433 protruding between the connecting portion 431 and the manipulation portion 432. The resilient arm 43 can resiliently move toward the housing body 41, and further has limiting portions 434 protruding at two sides of the manipulation portion 432 respectively to abut against two stopping portions 45 extending from the housing body 41 respectively, thereby restricting the resilient arms 43 to inclining excessively outwardly. The two protection blocks 44 are positioned at two sides of the connecting portion 431 respectively to protect the connecting portion 431 from being hit. When the plug connector 3 is correctly inserted, the plug connector 3 can enter into the mating space 24 along the mating direction to mate with the receptacle connector 1, and make the male latch unit 42 and the female latch unit 22 locked and positioned in a releasable manner. Specifically, the two protection blocks 44 and the connecting portion 431 are received inside of the U-shaped wall 221 of the female latch unit 22, and during a moving process of the plug connector 3 along the mating direction, the resilient arm 43 of the male latch unit 42 is first pressed by the U-shaped wall 221 to close to the housing body 41, when the plug connector 3 reaches a preset position, the resilient arm 43 resiliently moves outwardly so as to allow that the latching block 433 can enter into the latching hole 222, thereby locking the plug connector 3. At this time, the conductive insert plates 5 of the plug connector 3 are inserted and received in the slots 113 of the receptacle connector 1 respectively so as to contact the terminal 12 of the receptacle connector 1 to establish an electrical connection. In other words, by the guiding of the female latch unit 22 of the guide frame 2 and the stopping block 23, the conductive insert plates 5 of the plug connector 3 are more easily aligned with the slots 113 of the receptacle connector 1, and since the stopping block 23 has a guide surface 232, the housing body 41 of the plug connector 3 can enter into the mating space 24 more smoothly. If it is desired to disengage the plug connector 3 and the receptacle connector 1, a force is applied on the manipulation portion 432 of the resilient arm 43 and the manipulation portion 432 is pressed toward the direction of the housing body 41 and can drive the connecting portion 431 and the latching block 433 so as to make the latching block 433 move out of the latching hole 222, that is, the locking is released.

Figure 11:
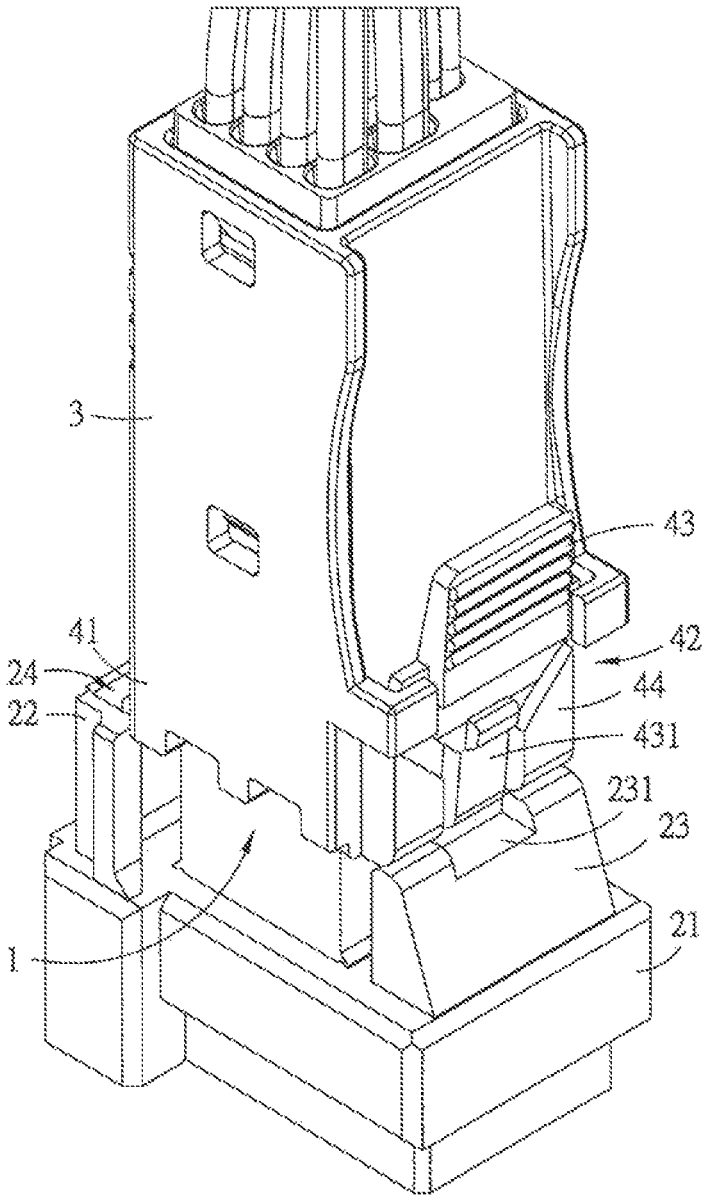
FIG. 11 is a perspective view illustrating an incorrectly inserted plug connector of the first embodiment.

Referring to FIG. 11, when the plug connector 3 is incorrectly inserted, the two protection blocks 44 abut against the top side of the stopping block 23, thereby making the plug connector 3 cannot enter into the mating space 24 and cannot mate with the receptacle connector 1, thus it can prevent a user from incorrectly inserting. Moreover, when the two protection blocks 44 abut against the stopping block 23, the connecting portion 431 of the resilient arm 43 is positioned correspondingly at the notch 231 but do not contact the stopping block 23, thereby avoiding the connecting portion 431 being hit and damaged.

Figure 3:
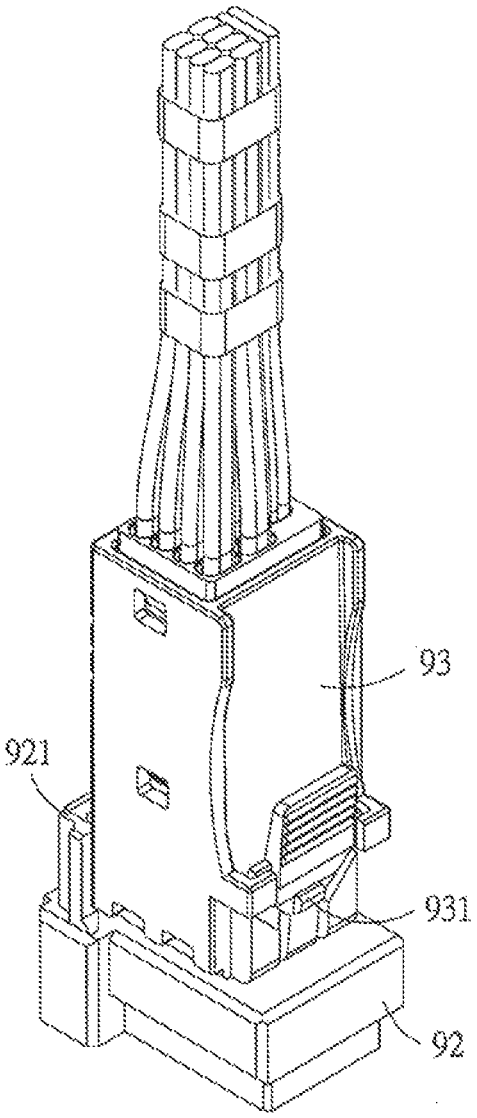
FIG. 3 PRIOR ART
FIG. 3 is a perspective view illustrating an existing electrical connection device, with a plug connector mated and incorrectly inserted into the receptacle connector.
Figure 4:
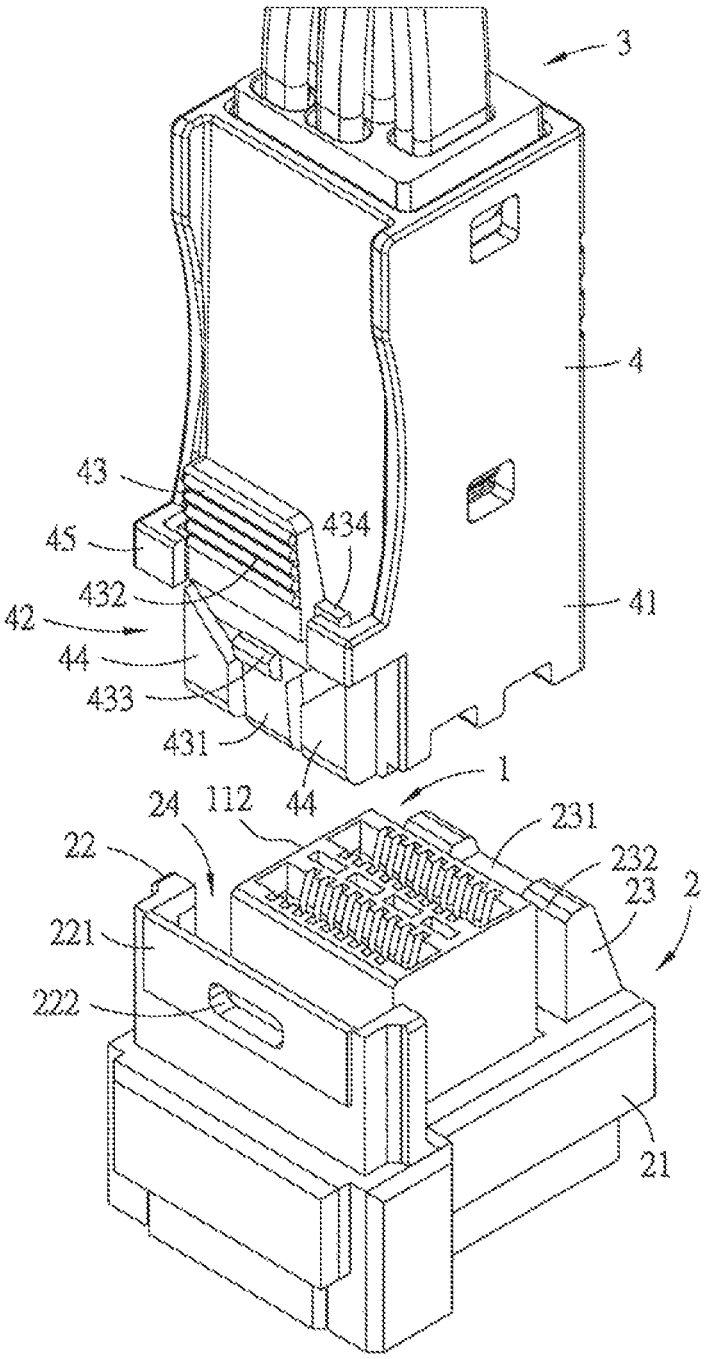
FIG. 4 is a perspective view illustrating an electrical connection device of a first embodiment of the Present Disclosure.
Figure 12:
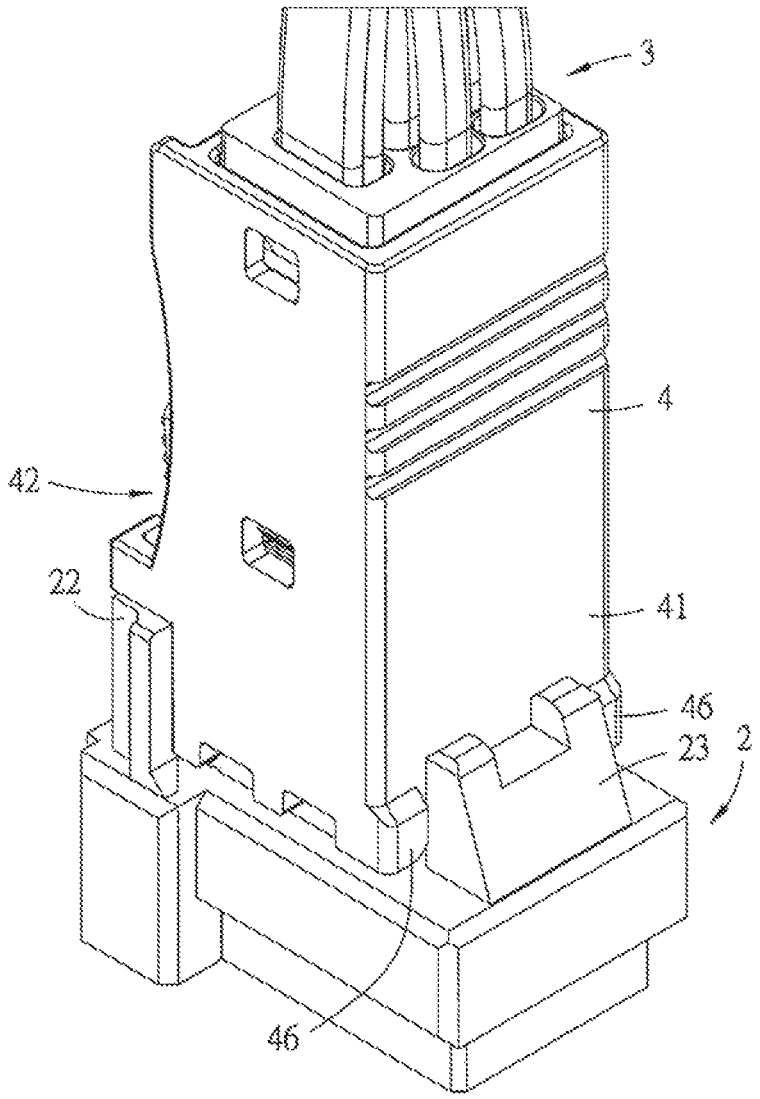
FIG. 12 is a perspective view illustrating an electrical connection device of a second embodiment of the Present Disclosure.
Figure 13:
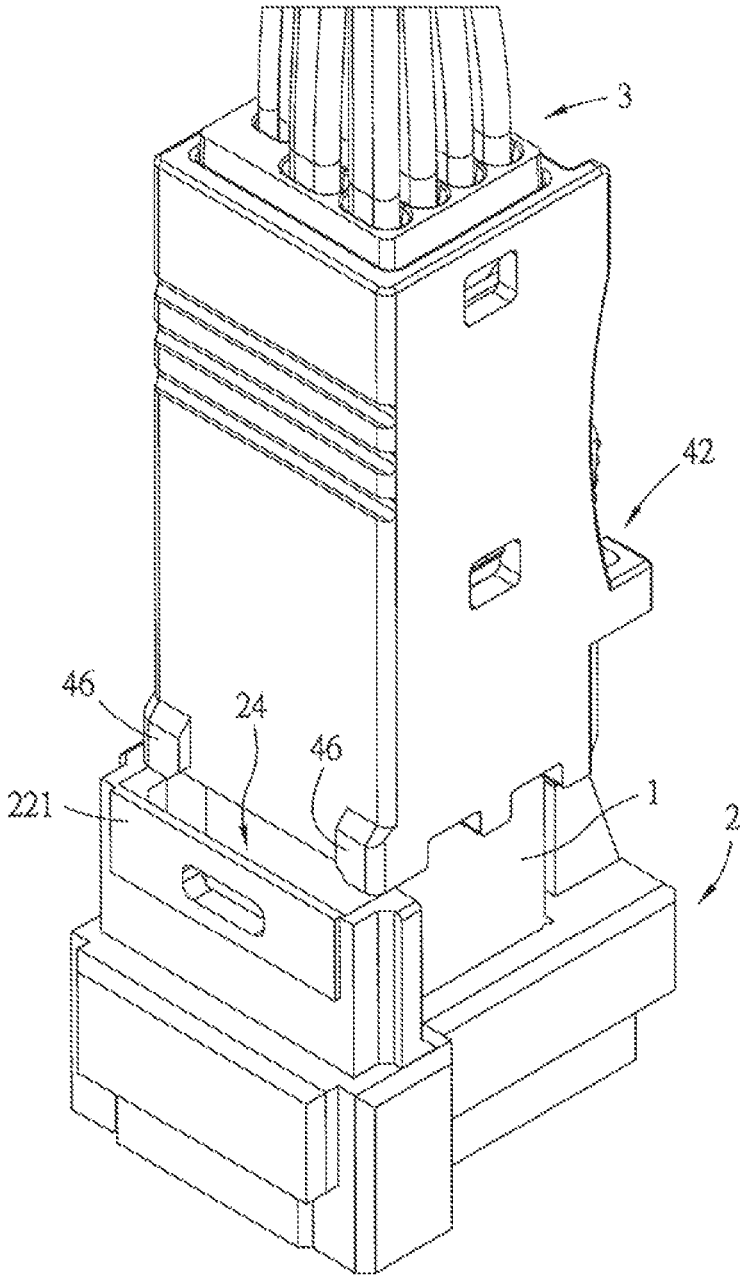
FIG. 13 is a perspective view illustrating an incorrectly inserted plug connector of the second embodiment.

Referring to FIGS. 12-3, an electrical connection device of a second embodiment of the Present Disclosure is substantially same as that of the first embodiment. However, in the second embodiment, the second insulative housing 4 of the plug connector 3 further has two protruding blocks 46 formed at two corners of one side of the housing body 41 opposite to the male latch unit 42. As shown in FIG. 12, when the plug connector 3 is correctly inserted, a spacing between the two protruding blocks 46 can receive the stopping block 23 of the guide frame 2; that is, the two protruding blocks 46 are positioned adjacent to the stopping block 23. As shown in FIG. 13, when the plug connector 3 is incorrectly inserted, the two protruding blocks 46 abut against a top side of the U-shaped wall 221 to make the plug connector 3 cannot enter into the mating space 24, thus it can prevent incorrect insertion. In the embodiment, the number of the protruding block 46 is two, but if one of them is provided, it can also achieve the effect of preventing from incorrectly inserting.

Figure 5:
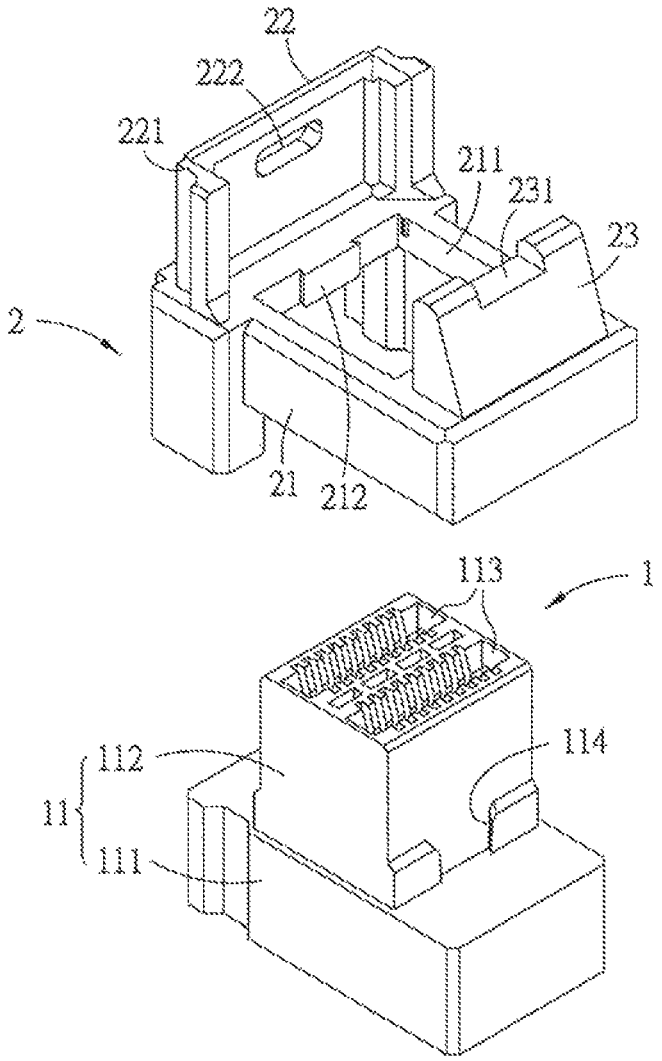
FIG. 5 is an exploded perspective view illustrating an assembly relationship of a receptacle connector and a guide frame of the first embodiment.
Figure 6:
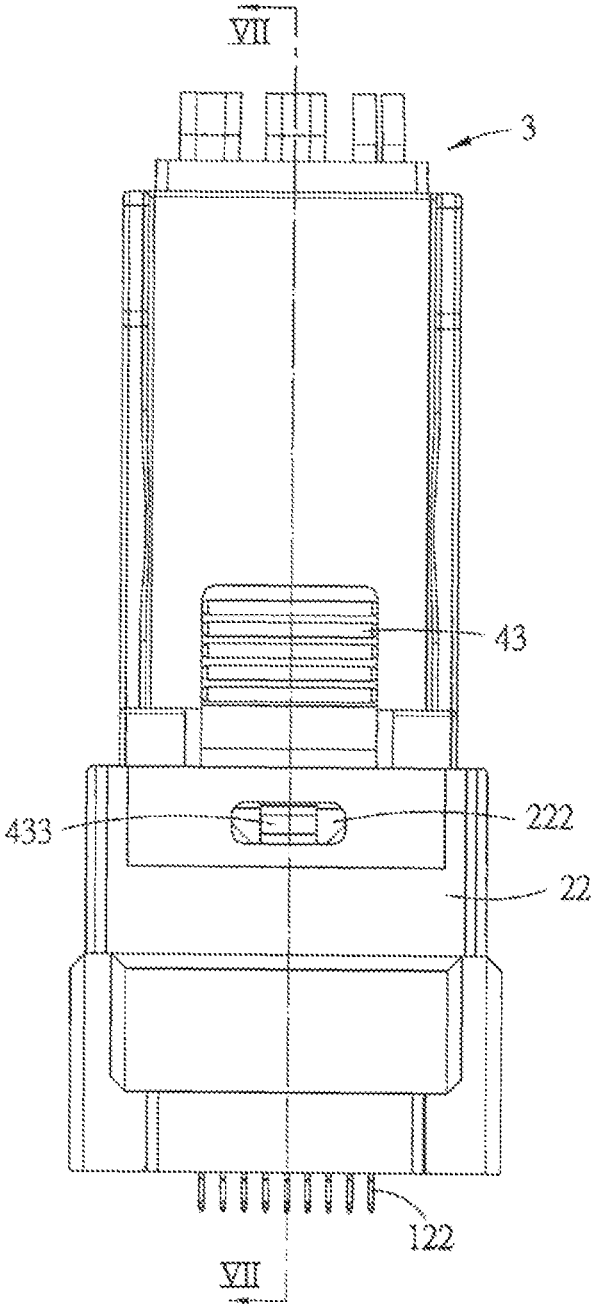
FIG. 6 is a front view illustrating a mating status of the plug connector and the receptacle connector of the first embodiment.
Figure 7:
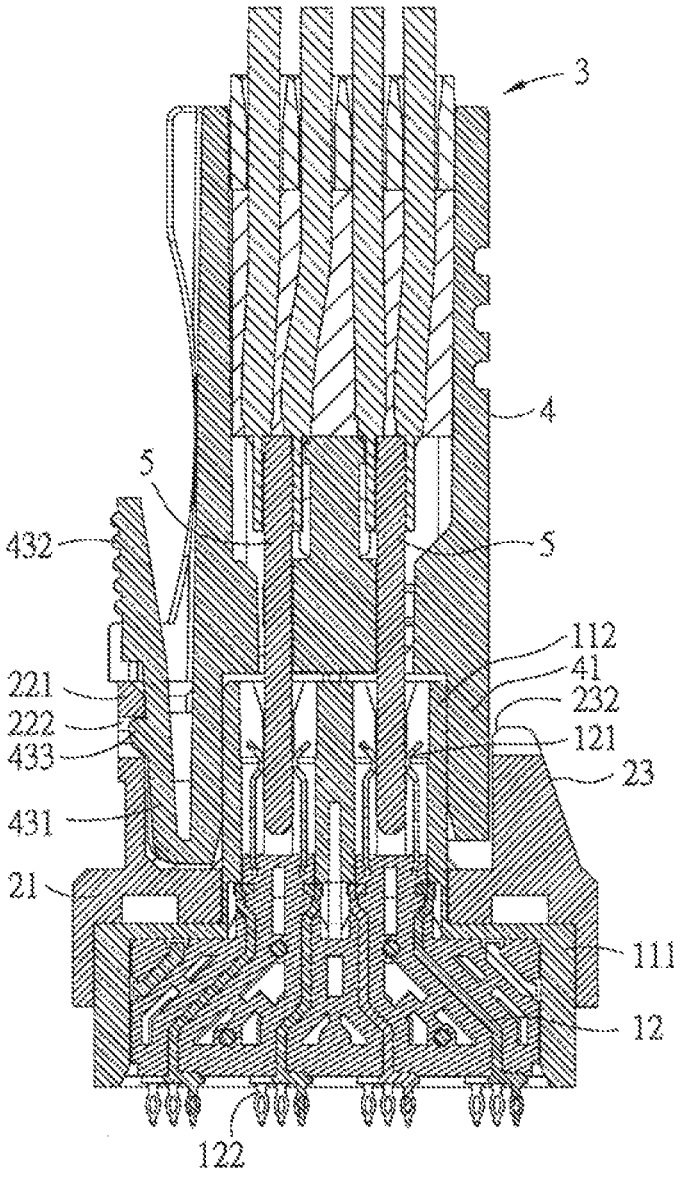
FIG. 7 is a cross-sectional view taken along Line VII of FIG. 6.
Figure 14:
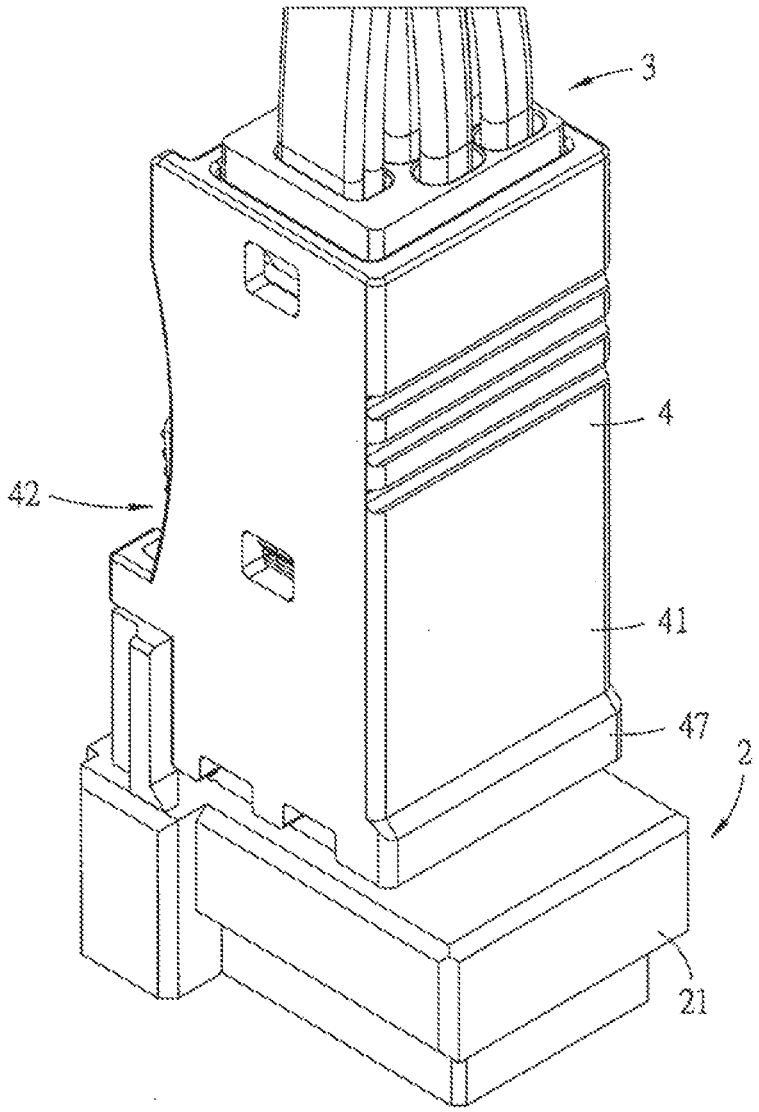
FIG. 14 is a perspective view illustrating an electrical connection device of a third embodiment of the Present Disclosure.
Figure 15:
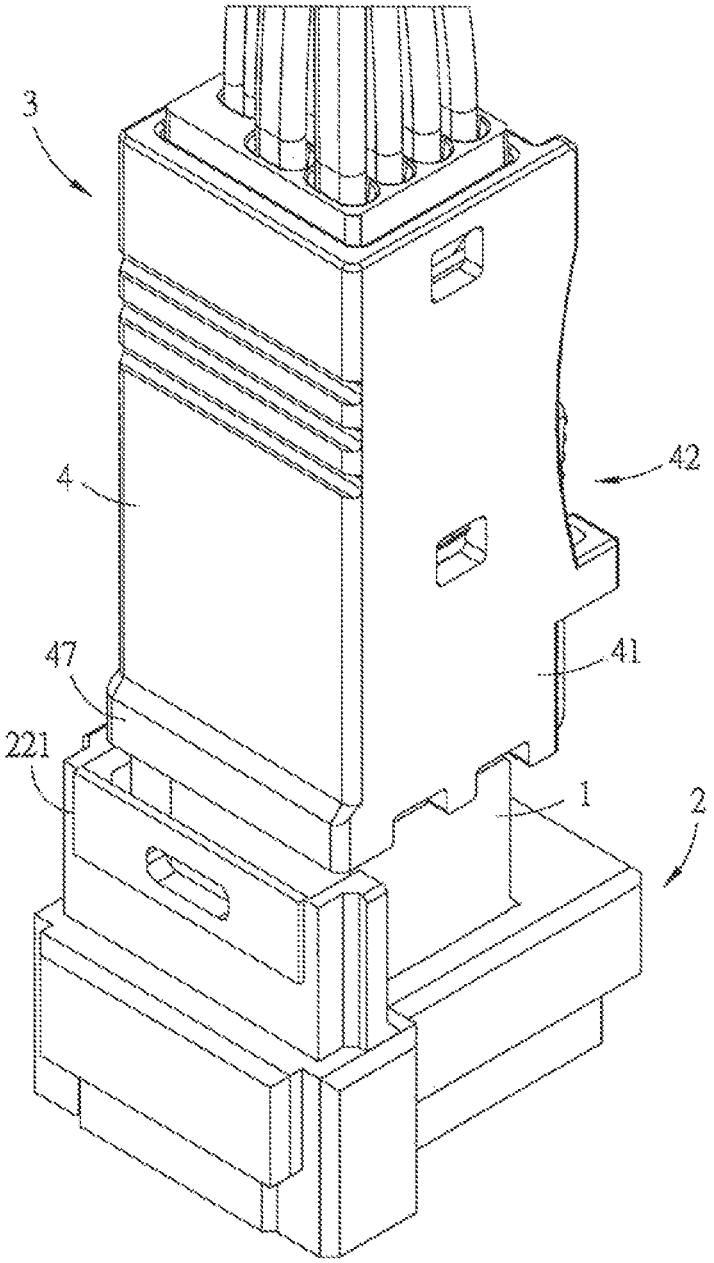
FIG. 15 is a perspective view illustrating an incorrectly inserted status plug connector of the third embodiment.

Referring to FIGS. 14-5, an electrical connection device of a third embodiment of the Present Disclosure is substantially same as that of the first embodiment. However, in the third embodiment, the guide frame 2 is not provided with the stopping block 23, but the second insulative housing 4 of the plug connector 3 further has a projection portion 47 formed at one side of the housing body 41 opposite to the male latch unit 42. As shown in FIG. 14, when the plug connector 3 is correctly inserted, the projection portion 47 can approximate to the frame body 21 of the guide frame 2 freely. As shown in FIG. 15, when the plug connector 3 is incorrectly inserted, the projection portion 47 abuts against the U-shaped wall 221 of the female latch unit 22, thereby making the plug connector 3 cannot mate with the receptacle connector 1, thus it can prevent the user from incorrectly inserting. In the embodiment, the projection portion 47 is a rectangular protruding rib.

However, the projection portion 47 can also be two protruding blocks or one protruding block positioned in corners or corner as in the second embodiment.

Figure 16:
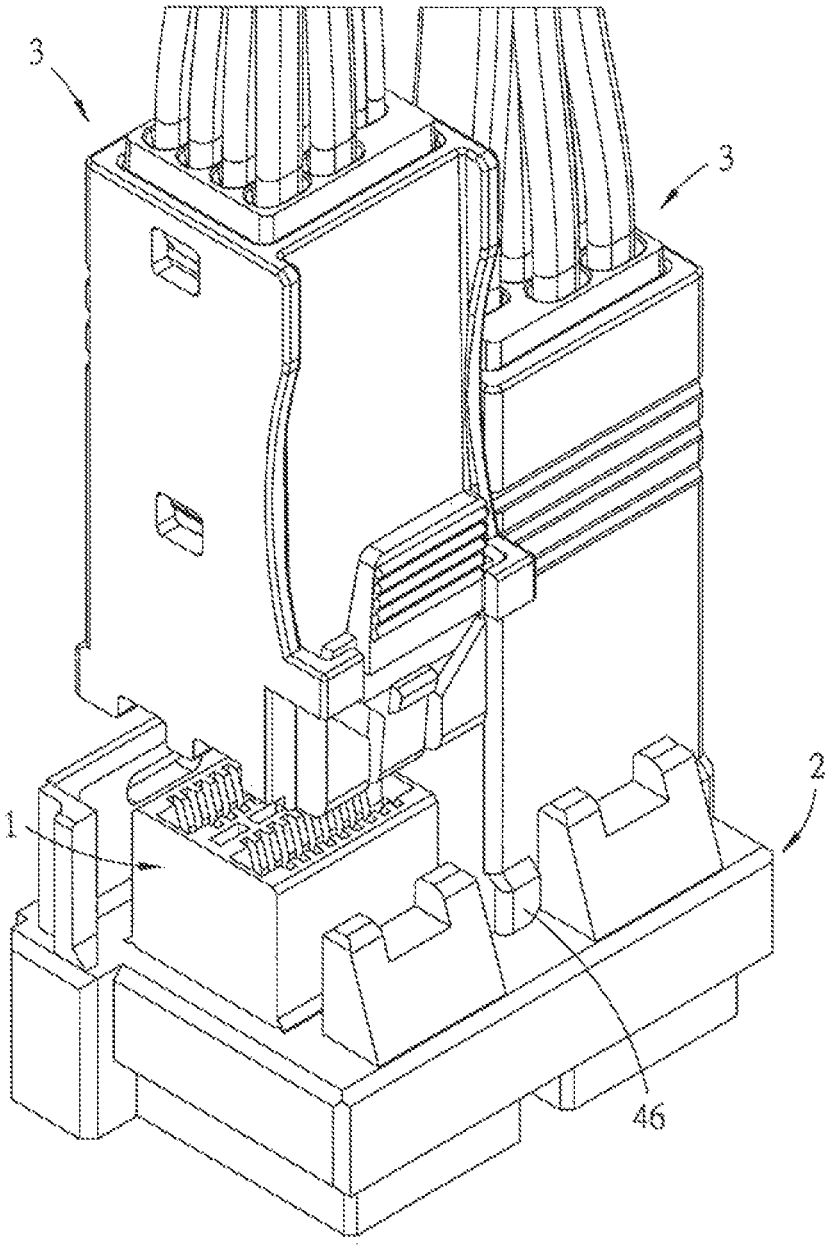
FIG. 16 is a perspective view illustrating an electrical connection device of a fourth embodiment of the Present Disclosure.

Referring to FIG. 16, an electrical connection device of a fourth embodiment of the Present Disclosure is substantially same as that of the second embodiment. However, in the fourth embodiment, a plurality of receptacle connectors 1 is provided in a side-by side manner and the individual guide frames 2 are formed integrally as a unitary one. However, a plurality of plug connectors 3 can individually mate with a single corresponding receptacle connector 1. Similarly, for each plug connector 3, it can achieve the effect of preventing from incorrectly inserting.

Figure 17:
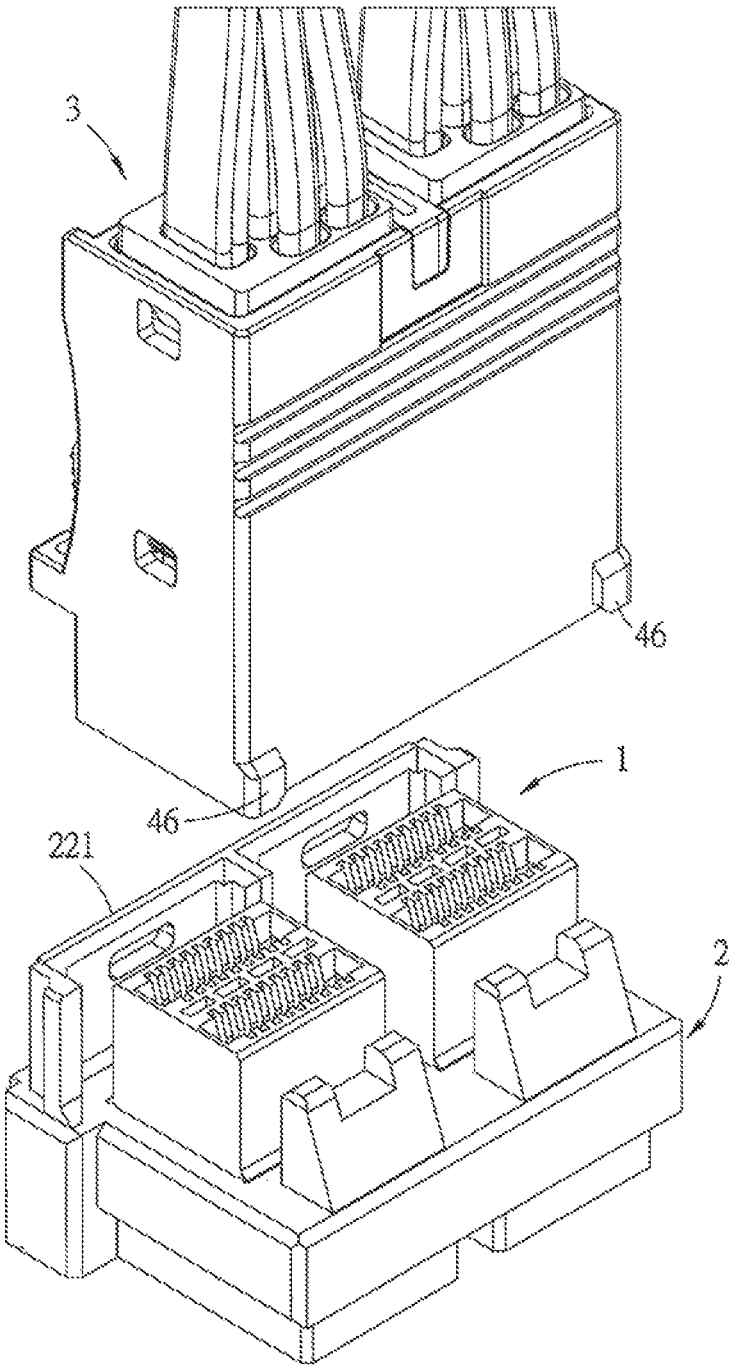
FIG. 17 is a perspective view illustrating an electrical connection device of a fifth embodiment of the Present Disclosure.
Figure 18:
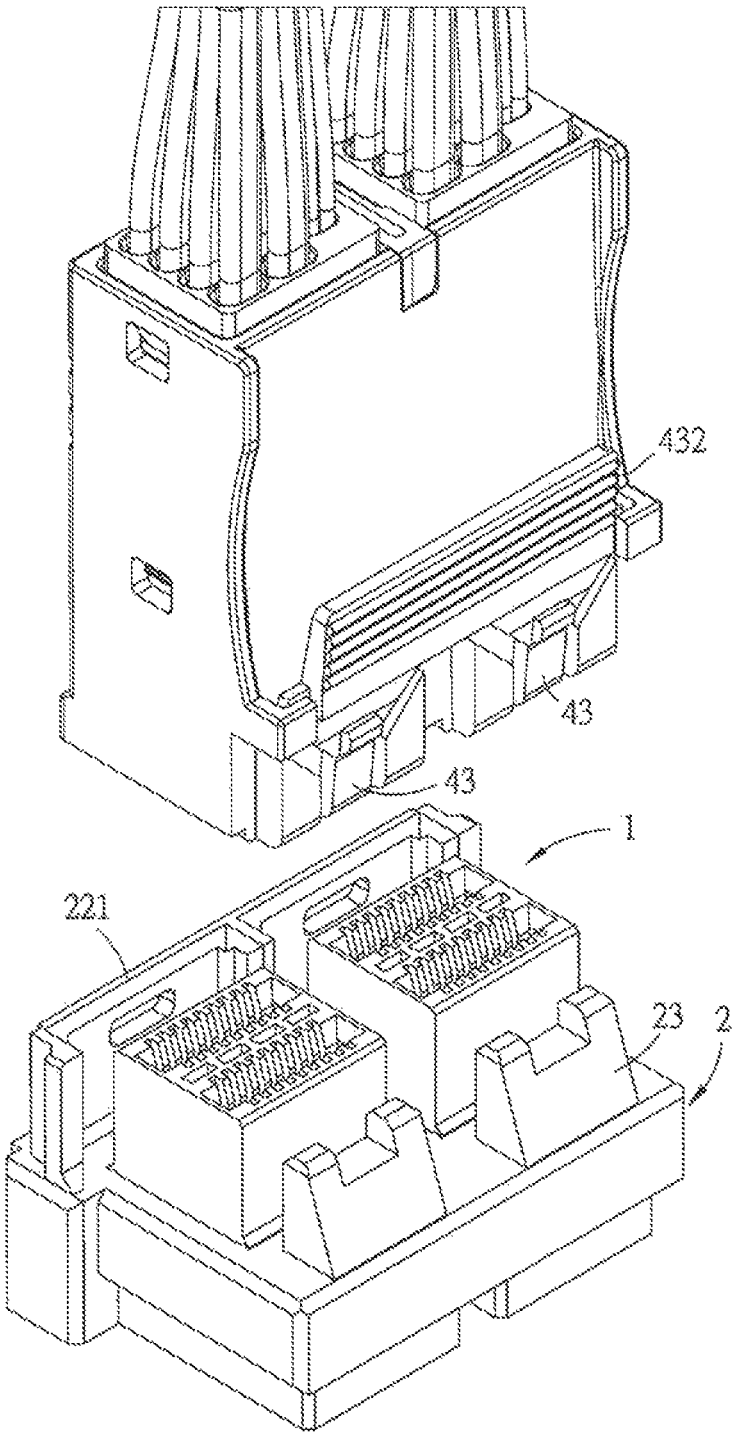
FIG. 18 is a perspective view illustrating an incorrectly inserted plug connector of the fifth embodiment.

Referring to FIGS. 17-8, an electrical connection device of a fifth embodiment of the Present Disclosure is substantially same as that of the fourth embodiment. However, in the fifth embodiment, a plurality of plug connectors 3 are also provided in a side-by-side manner to correspondingly mate with a plurality of receptacle connectors 1 at the same time, with individual manipulations portion 432 of the resilient arms 43 of the plug connector 3 are connected together to facilitate the operation at the same time. Similarly, when the plug connector 3 is incorrectly inserted, the protruding blocks 46 abut against the top side of the U-shaped wall 221, thus it can prevent the user from incorrectly inserting.

In conclusion, when the plug connector 3 of the embodiments of the Present Disclosure is incorrectly inserted, the plug connector 3 cannot mate with the receptacle connector 1 due to blocking from the guide frame 2, which can effectively prevent the user from incorrectly inserting and definitely achieve the object of the Present Disclosure.

While a preferred embodiment of the Present Disclosure is shown and described, it is envisioned that those skilled in the art may devise various modifications without departing from the spirit and scope of the foregoing Description and the appended Claims.

What is claimed is:

1. An electrical connection device, the electrical connection device comprising:

a receptacle connector, the receptacle connector comprising a first insulative housing, the first insulative housing having a mounting portion and a mating portion protruding from the mounting portion;

a guide frame assembled with the receptacle connector, the guide frame including a frame body, a female latch unit and a stopping block, the frame body being assembled to the receptacle connector mounting portion and having an opening to allow the receptacle connector mating portion to pass through, the female latch unit and the stopping block protruding from the frame body and being positioned at opposite sides of the receptacle connector mating portion and spaced apart from the receptacle connector mating portion to define a mating space with two slots spaced apart from each other in a first direction and an opposite sides of the receptacle connector mating portion; and a plug connector, the plug connector including a second insulative housing and a male latch unit, the second insulative housing including a housing body mated to the mating portion, the male latch unit being formed at one side of the plug connector housing body and engaged with the female latch unit, the plug connector housing body further including a pair of protruding blocks disposed on an opposite side of the plug connector housing body, the pair of protruding blocks being spaced apart from each other in a second direction that is perpendicular to the first direction, the pair of protruding blocks defining a receiving space therebetween for the stopping block;

wherein:

when the plug connector is correctly inserted, two portions of the plug connector enter the mating space two slots along a mating direction to mate with the receptacle connector, locking the male latch unit and the female latch unit and positioning the male latch unit and the female latch unit in a releasable manner; and when the plug connector is incorrectly inserted, the plug connector cannot enter into the mating space to mate with the receptacle connector due to the stopping block.

2. The electrical connection device of claim 1, wherein the male latch unit includes a resilient arm and two protection blocks positioned at opposing sides of the resilient arm.

3. The electrical connection device of claim 2, wherein the stopping block includes a notch recessed from a middle portion of a top side thereof.

4. The electrical connection device of claim 3, wherein, when the plug connector is incorrectly inserted along the mating direction, the two protection blocks abut against the top side of the stopping block and the resilient arm is positioned correspondingly at the notch and does not contact the stopping block.

5. The electrical connection device of claim 1, wherein, when the plug connector is correctly inserted into the mating space, the protruding blocks lie adjacent to the stopping block on opposite sides thereof.

6. The electrical connection device of claim 5, wherein, when the plug connector is incorrectly inserted, the protruding blocks abut against the female latch unit to make the plug connector cannot enter into the mating space.

7. The electrical connection device of claim 6, wherein the female latch unit has a U-shaped wall.

8. The electrical connection device of claim 7, wherein a latching hole is formed in the U-shaped wall.

9. The electrical connection device of claim 8, wherein the resilient arm of the male latch unit has a connecting portion extending from the housing body, a manipulation portion extending from the connecting portion and a latching block protruding between the connecting portion and the manipulation portion, the two protection blocks being positioned at two sides of the connecting portion respectively.

10. The electrical connection device of claim 9, wherein, when the plug connector is correctly inserted, the two protection blocks and the connecting portion are received inside of the U-shaped wall and the latching block can insert into the latching hole, and the protruding block is adjacent to the stopping block.

11. The electrical connection device of claim 10, wherein, when the plug connector is incorrectly inserted, the protruding block abuts against the top side of the U-shaped wall to make the plug connector cannot enter into the mating space.

12. The electrical connection device of claim 1, wherein a side edge of the top side of the stopping block adjacent to the mating portion is formed as a guide surface.

13. The electrical connection device of claim 1, wherein the mounting portion of the first insulative housing is engaged with the guide frame via engagement of a dovetail block and a dovetail groove, and the receptacle connector, along with the guide frame, is mounted on a circuit board, the mating direction being perpendicular to the circuit board.

14. An electrical connection device, the electrical connection device comprising:

a receptacle connector, the receptacle connector comprising a first insulative housing, the first insulative housing having a mounting portion and a mating portion protruding from the receptacle connector mounting portion, the receptacle connector mating portion including a plurality of terminal-receiving slots and a plurality of conductive terminals disposed with the terminal-receiving slots;

a guide frame assembled with the receptacle connector, the guide frame including a frame body and a female latch unit, the frame body being assembled to the mounting portion of the first insulative housing and having an opening to allow the receptacle connector mating portion to pass through, the female latch unit protruding from the frame body and being spaced apart from a first side of the receptacle connector mating portion to define a first portion of a receptacle connector mating space, the guide frame further including a stopping block protruding from the frame body and being spaced apart from a second side of the receptacle connector mating portion to define a second portion of a receptacle connector mating space, the first and second portions of the receptacle connector mating space being disposed along different sides of the receptacle connector mating portion and spaced apart from each other in a first direction; and a plug connector, the plug connector comprising a second insulative housing, a male latch unit and a projection portion, the second insulative housing including a housing body mated to the mating portion, the male latch unit being formed on a first side of the housing body and the projection portion also being formed on the first side of the housing body, the second housing further including a pair of protruding blocks disposed on a second side of the plug connector housing body, different than the first side of the plug connector housing body, the pair of protruding blocks being spaced apart from each other in a second direction that is perpendicular to the first direction, the pair of protruding blocks defining a receiving space therebetween for the stopping block, the receiving space and the first and second portions of the receptacle connector mating space all extending in a widthwise direction;

wherein:

when the plug connector is correctly inserted, the plug connector mates with the receptacle connector along a mating direction to lock the male latch unit and the female latch unit locked and position the male latch unit and the female latch unit in a releasable manner; and when the plug connector is incorrectly inserted, the protruding blocks collide with the female latch unit and the projection portion collides with the stopping block, thereby preventing the plug connector from mating with the receptacle connector.

15. The electrical connection device of claim 14, wherein:

the female latch unit has a U-shaped wall;

a latching hole is formed in the U-shaped wall;

the male latch unit includes a resilient arm, a connecting portion extending from the housing body, a manipulation portion extending from the connecting portion, and a latching block protruding between the connecting portion and the manipulation portion, two protection blocks positioned at two sides of the connecting portion respectively when the plug connector is correctly inserted, the two protection blocks and the connecting portion are received inside of the U-shaped wall and the latching block can insert into the latching hole; and when the plug connector is incorrectly inserted, the projection portion abuts against a top side of the U-shaped wall.

16. The electrical connection device of claim 14, wherein the mounting portion of the first insulative housing engages the guide frame via engagement of a dovetail block and a dovetail groove, and the receptacle connector, along with the guide frame, is mounted on a circuit board, the mating direction is perpendicular to a circuit board on which the receptacle connector mounting portion is mounted.

* * * * *